US009470115B2

(12) United States Patent
Ernst et al.

(10) Patent No.: US 9,470,115 B2
(45) Date of Patent: Oct. 18, 2016

(54) SPLIT RADIATOR DESIGN FOR HEAT REJECTION OPTIMIZATION FOR A WASTE HEAT RECOVERY SYSTEM

(75) Inventors: Timothy C. Ernst, Columbus, IN (US); Christopher R. Nelson, Columbus, IN (US)

(73) Assignee: CUMMINS INTELLECTUAL PROPERTY, INC., Minneapolis, MN (US)

( * ) Notice: Subject to any disclaimer, the term of this patent is extended or adjusted under 35 U.S.C. 154(b) by 737 days.

(21) Appl. No.: 13/816,446

(22) PCT Filed: Aug. 11, 2011

(86) PCT No.: PCT/US2011/047494

§ 371 (c)(1),
(2), (4) Date: Sep. 27, 2013

(87) PCT Pub. No.: WO2012/021757

PCT Pub. Date: Feb. 16, 2012

(65) Prior Publication Data

US 2014/0007575 A1 Jan. 9, 2014

Related U.S. Application Data

(60) Provisional application No. 61/372,472, filed on Aug. 11, 2010.

(51) Int. Cl.
*F01K 23/10* (2006.01)
*F01K 23/06* (2006.01)
(Continued)

(52) U.S. Cl.
CPC ..... *F01K 23/101* (2013.01); *F01K 23/065* (2013.01); *F01K 25/10* (2013.01); *F01P 9/06* (2013.01); *F01P 2003/187* (2013.01)

(58) Field of Classification Search
USPC ..... 60/618, 597; 123/41.31, 540, 568.12
See application file for complete search history.

(56) References Cited

U.S. PATENT DOCUMENTS 3,232,052 A 2/1966 Ricard
3,789,804 A 2/1974 Aguet
(Continued)

FOREIGN PATENT DOCUMENTS

EP 1 273 785 B1 5/2007
JP 60-222511 A 11/1985
(Continued)

OTHER PUBLICATIONS

International Search Report and Written Opinion of the International Searching Authority mailed Mar. 19, 2012 from corresponding International Application No. PCT/US2011/047494.

*Primary Examiner* — Kenneth Bomberg
*Assistant Examiner* — Paul Thiede
(74) *Attorney, Agent, or Firm* — Foley & Lardner LLP

(57) ABSTRACT

A cooling system provides improved heat recovery by providing a split core radiator for both engine cooling and condenser cooling for a Rankine cycle (RC). The cooling system includes a radiator having a first cooling core portion and a second cooling core portion. An engine cooling loop is fluidly connected the second cooling core portion. A condenser of an RC has a cooling loop fluidly connected to the first cooling core portion. A valve is provided between the engine cooling loop and the condenser cooling loop adjustably control the flow of coolant in the condenser cooling loop into the engine cooling loop. The cooling system includes a controller communicatively coupled to the valve and adapted to determine a load requirement for the internal combustion engine and adjust the valve in accordance with the engine load requirement.

17 Claims, 4 Drawing Sheets

(51) Int. Cl.

| | |
|---|---|
| ***F01P 3/18*** | (2006.01) |
| ***F01K 25/10*** | (2006.01) |
| ***F01P 9/06*** | (2006.01) |

(56) References Cited

U.S. PATENT DOCUMENTS

| | | | |
|---|---|---|---|
| 4,009,587 | A | 3/1977 | Robinson, Jr. et al. |
| 4,164,850 | A | 8/1979 | Lowi, Jr. |
| 4,204,401 | A | 5/1980 | Earnest |
| 4,232,522 | A | 11/1980 | Steiger |
| 4,267,692 | A | 5/1981 | Earnest |
| 4,271,664 | A | 6/1981 | Earnest |
| 4,428,190 | A | 1/1984 | Bronicki |
| 4,458,493 | A | 7/1984 | Amir et al. |
| 4,581,897 | A | 4/1986 | Sankrithi |
| 4,630,572 | A | 12/1986 | Evans |
| 4,831,817 | A | 5/1989 | Linhardt |
| 4,873,829 | A | 10/1989 | Williamson |
| 4,911,110 | A | 3/1990 | Isoda et al. |
| 5,121,607 | A | 6/1992 | George, Jr. |
| 5,207,188 | A | 5/1993 | Hama et al. |
| 5,421,157 | A | 6/1995 | Rosenblatt |
| 5,649,513 | A | 7/1997 | Kanda |
| 5,685,152 | A | 11/1997 | Sterling |
| 5,771,868 | A | 6/1998 | Khair |
| 5,806,322 | A | 9/1998 | Cakmakci et al. |
| 5,915,472 | A | 6/1999 | Takikawa et al. |
| 5,950,425 | A | 9/1999 | Takahashi et al. |
| 6,014,856 | A | 1/2000 | Bronicki et al. |
| 6,035,643 | A | 3/2000 | Rosenblatt |
| 6,055,959 | A | 5/2000 | Taue |
| 6,128,905 | A | 10/2000 | Fahlsing |
| 6,138,649 | A | 10/2000 | Khair et al. |
| 6,301,890 | B1 | 10/2001 | Zeretzke |
| 6,321,697 | B1 | 11/2001 | Matsuda et al. |
| 6,324,849 | B1 | 12/2001 | Togawa et al. |
| 6,393,840 | B1 | 5/2002 | Hay |
| 6,494,045 | B2 | 12/2002 | Rollins, III |
| 6,523,349 | B2 | 2/2003 | Viteri |
| 6,571,548 | B1 | 6/2003 | Bronicki et al. |
| 6,598,397 | B2 | 7/2003 | Hanna et al. |
| 6,606,848 | B1 | 8/2003 | Rollins, III |
| 6,637,207 | B2 | 10/2003 | Konezciny et al. |
| 6,701,712 | B2 | 3/2004 | Bronicki et al. |
| 6,715,296 | B2 | 4/2004 | Bakran et al. |
| 6,745,574 | B1 | 6/2004 | Dettmer |
| 6,748,934 | B2 | 6/2004 | Natkin et al. |
| 6,751,959 | B1 | 6/2004 | McClanahan et al. |
| 6,792,756 | B2 | 9/2004 | Bakran et al. |
| 6,810,668 | B2 | 11/2004 | Nagatani et al. |
| 6,817,185 | B2 | 11/2004 | Coney et al. |
| 6,848,259 | B2 | 2/2005 | Keller-Sornig et al. |
| 6,877,323 | B2 | 4/2005 | Dewis |
| 6,880,344 | B2 | 4/2005 | Radcliff et al. |
| 6,910,333 | B2 | 6/2005 | Minemi et al. |
| 6,964,168 | B1 | 11/2005 | Pierson et al. |
| 6,977,983 | B2 | 12/2005 | Correia et al. |
| 6,986,251 | B2 | 1/2006 | Radcliff et al. |
| 7,007,487 | B2 | 3/2006 | Belokon et al. |
| 7,028,463 | B2 | 4/2006 | Hammond et al. |
| 7,044,210 | B2 | 5/2006 | Usui |
| 7,069,884 | B2 | 7/2006 | Baba et al. |
| 7,117,827 | B1 | 10/2006 | Hinderks |
| 7,121,906 | B2 | 10/2006 | Sundel |
| 7,131,259 | B2 | 11/2006 | Rollins, III |
| 7,131,290 | B2 | 11/2006 | Taniguchi et al. |
| 7,159,400 | B2 | 1/2007 | Tsutsui et al. |
| 7,174,716 | B2 | 2/2007 | Brasz et al. |
| 7,174,732 | B2 | 2/2007 | Taniguchi et al. |
| 7,191,740 | B2 | 3/2007 | Baba et al. |
| 7,200,996 | B2 | 4/2007 | Cogswell et al. |
| 7,225,621 | B2 | 6/2007 | Zimron et al. |
| 7,281,530 | B2 | 10/2007 | Usui |
| 7,325,401 | B1 | 2/2008 | Kesseli et al. |
| 7,340,897 | B2 | 3/2008 | Zimron et al. |
| 7,454,911 | B2 | 11/2008 | Tafas |
| 7,469,540 | B1 | 12/2008 | Knapton et al. |
| 7,578,139 | B2 | 8/2009 | Nishikawa et al. |
| 7,665,304 | B2 | 2/2010 | Sundel |
| 7,721,552 | B2 | 5/2010 | Hansson et al. |
| 7,797,940 | B2 | 9/2010 | Kaplan |
| 7,823,381 | B2 | 11/2010 | Misselhorn |
| 7,833,433 | B2 | 11/2010 | Singh et al. |
| 7,866,157 | B2 | 1/2011 | Ernst et al. |
| 7,942,001 | B2 | 5/2011 | Radcliff et al. |
| 7,958,873 | B2 | 6/2011 | Ernst et al. |
| 7,997,076 | B2 | 8/2011 | Ernst |
| 2002/0099476 | A1 | 7/2002 | Hamrin et al. |
| 2003/0033812 | A1 | 2/2003 | Gerdes et al. |
| 2003/0213245 | A1 | 11/2003 | Yates et al. |
| 2003/0213246 | A1 | 11/2003 | Coll et al. |
| 2003/0213248 | A1 | 11/2003 | Osborne et al. |
| 2005/0262842 | A1 | 12/2005 | Claassen et al. |
| 2008/0289313 | A1 | 11/2008 | Batscha et al. |
| 2009/0031724 | A1 | 2/2009 | Ruiz |
| 2009/0090109 | A1 | 4/2009 | Mills et al. |
| 2009/0121495 | A1 | 5/2009 | Mills |
| 2009/0133646 | A1 | 5/2009 | Wankhede et al. |
| 2009/0151356 | A1 | 6/2009 | Ast et al. |
| 2009/0179429 | A1 | 7/2009 | Ellis et al. |
| 2009/0211253 | A1 | 8/2009 | Radcliff et al. |
| 2009/0320477 | A1 | 12/2009 | Juchymenko |
| 2009/0322089 | A1 | 12/2009 | Mills et al. |
| 2010/0018207 | A1 | 1/2010 | Juchymenko |
| 2010/0071368 | A1 | 3/2010 | Kaplan et al. |
| 2010/0083919 | A1 | 4/2010 | Bucknell |
| 2010/0101224 | A1* | 4/2010 | Kasuya et al. ..... 60/597 |
| 2010/0139626 | A1 | 6/2010 | Raab et al. |
| 2010/0180584 | A1 | 7/2010 | Berger et al. |
| 2010/0192569 | A1 | 8/2010 | Ambros et al. |
| 2010/0229525 | A1 | 9/2010 | Mackay et al. |
| 2010/0257858 | A1 | 10/2010 | Yaguchi et al. |
| 2010/0263380 | A1 | 10/2010 | Biederman et al. |
| 2010/0282221 | A1 | 11/2010 | Le Lievre |
| 2010/0288571 | A1 | 11/2010 | Dewis et al. |
| 2011/0005477 | A1 | 1/2011 | Terashima et al. |
| 2011/0006523 | A1 | 1/2011 | Samuel |
| 2011/0094485 | A1 | 4/2011 | Vuk et al. |
| 2011/0209473 | A1 | 9/2011 | Fritz et al. |
| 2012/0023946 | A1 | 2/2012 | Ernst et al. |

FOREIGN PATENT DOCUMENTS

| | | | |
|---|---|---|---|
| JP | 8-68318 | A | 3/1996 |
| JP | 9-32653 | A | 2/1997 |
| JP | 10-238418 | A | 9/1998 |
| JP | 11-166453 | A | 6/1999 |
| JP | 2005-36787 | A | 2/2005 |
| JP | 2005-42618 | A | 2/2005 |
| JP | 2005-201067 | A | 7/2005 |
| JP | 2005-329843 | A | 12/2005 |
| JP | 2007-332853 | A | 12/2007 |
| JP | 2008-240613 | A | 10/2008 |
| JP | 2009-167995 | A | 7/2009 |
| JP | 2009-191647 | A | 8/2009 |
| JP | 2010-77964 | A | 4/2010 |
| WO | 2009/098471 | A2 | 8/2009 |

* cited by examiner

SPLIT RADIATOR DESIGN FOR HEAT REJECTION OPTIMIZATION FOR A WASTE HEAT RECOVERY SYSTEM

CROSS REFERENCE TO RELATED APPLICATIONS

This application claims benefit of priority to Provisional Patent Application No. 61/372,472, filed on Aug. 11, 2010, the entire contents of which are hereby incorporated by reference.

STATEMENT REGARDING FEDERALLY SPONSORED RESEARCH OR DEVELOPMENT

This invention was made with government support under "Exhaust Energy Recovery," contract number DE-FC26-05NT42419 awarded by the Department of Energy (DOE). The government has certain rights in the invention.

FIELD OF THE INVENTION

The inventions relate to waste heat recovery systems, and more particularly, to a system and method that cools an internal combustion engine and a condenser of a Rankine cycle used with the internal combustion engine using a split core radiator.

BACKGROUND

A Rankine cycle (RC) can capture a portion of heat energy that normally would be wasted ("waste heat") and convert a portion of that captured heat energy into energy that can perform useful work or into some other form of energy. Systems utilizing an RC are sometimes called waste heat recovery (WHR) systems. For example, heat from an internal combustion engine system such as exhaust gas heat energy and other engine heat sources (e.g., engine oil, exhaust gas, charge gas, water jackets) can be captured and converted to useful energy (e.g., electrical or mechanical energy). In this way, a portion of the waste heat energy can be recovered to increase the efficiency of a system including one or more waste heat sources.

An RC system includes a condenser element to decrease the temperature of the working fluid such that working fluid discharged from the condenser is in a low temperature, low pressure liquid state. To cool the working fluid of the RC, heat from the working fluid is transferred to a low temperature source (e.g., glycol, water etc.) coupled to condenser, and the heated low temperature source is cooled, for example, in a radiator.

SUMMARY

The disclosure provides a cooling system that can provide improved heat recovery in a waste heat recovery (WHR) system by providing a split core radiator for both engine cooling and condenser cooling for a Rankine cycle (RC).

In an embodiment, a cooling system for an internal combustion engine and WHR system utilizing an RC includes a radiator having a first cooling core portion and a second cooling core portion positioned in a downstream direction of forced cooling air from the first cooling core portion, and an engine cooling loop including an engine coolant return line fluidly connected to an inlet of the second cooling core portion, and an engine coolant feed line connected to an outlet of the second cooling core portion. A condenser of the RC of the WHR system is fluidly coupled to a condenser cooling loop including a condenser coolant return line fluidly connected to an inlet of the first cooling core portion and a condenser coolant feed line fluidly connected an outlet of the first cooling core portion.

A valve is connected between the engine cooling loop and the condenser cooling loop and is configured to adjustably control the flow of coolant in the condenser cooling loop into the engine cooling loop.

The cooling system includes a controller communicatively coupled to the valve. The controller is adapted to determine a load requirement for the internal combustion engine and adjust the valve in accordance with the engine load requirement.

DETAILED DESCRIPTION

Figure 1:
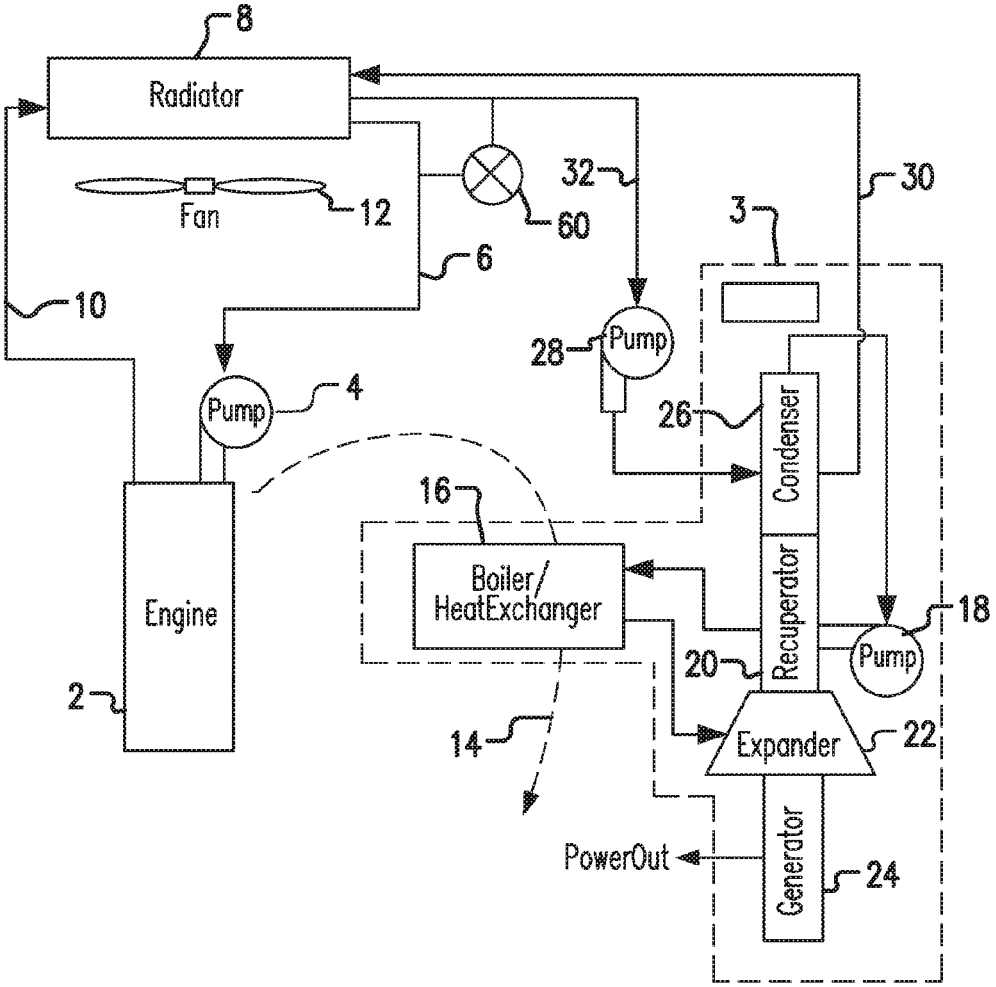
FIG. 1 is a diagram of cooling system according to a generalized exemplary embodiment.

Various aspects are described hereafter in connection with exemplary embodiments to facilitate an understanding of the invention. However, the invention should not be construed as being limited to these embodiments. Rather, these embodiments are provided so that the disclosure will be thorough and complete, and will fully convey the scope of the invention to those skilled in the art. Descriptions of well-known functions and constructions are omitted for clarity and conciseness.

Interest is increasing in use of an RC, such as an organic Rankine cycle (ORC), to increase the thermal efficiency of a diesel engine. As will be described in greater detail below, an RC utilizes a condenser, which is cooled to condense hot vapor of the RC working fluid and maintain a desired amount of heat rejection from a waste heat source passed through the boiler of the RC.

The condenser heat load for an RC waste heat recovery system must be rejected to the ambient air. At the same time, increased cooling capacity in the condenser cooler is required for more efficient operation of the cycle. However, heat rejection space claim is currently limited on vehicles, which can prohibit making adding additional heat rejection capability.

As described herein, embodiments can utilize a vehicle's current radiator space claim more effectively across the engine's entire operating map. Currently, the engine's radiator is designed for the peak heat rejection requirement of the engine and vehicle at the rated condition. When the engine operates at off-peak conditions, the radiator is significantly oversized for the required engine and vehicle cooling; and the engine spends a large fraction of time at off-peak conditions. A split radiator design, as described later in detail, allows the waste heat recovery cycle to exploit the "oversized" radiator for additional condenser cooling when the engine is at off-peak conditions. The radiator can accomplish this by employing a split design in conjunction with a mixing valve where coolant for the engine flows through only a portion of the radiator, and that portion size can depend on engine cooling requirements. This allows the rest of the radiator to be used for cooling an RC condenser, especially in off peak operating conditions. The fluid returning to the condenser cooler is able to reach much lower temperatures by using the unneeded space claim at part load operation. At rated condition, the system can adjust to allow the engine coolant to utilize the the entire radiator. The efficiency of the waste heat recovery system would then decrease accordingly, but time spent at this condition is limited.

Thus, embodiments consistent with the invention allow the radiator to be utilized for both engine cooling and condenser cooling for a Rankine cycle by using a split core design with flow controlled by a valve. The Rankine cycle efficiency can benefit significantly by using the oversized portion of the radiator at part load, where the engine operates the majority of the time.

The concepts described herein can be applied to any engine employing a Rankine cycle waste heat recovery (WHR) system to increase the efficiency of the power conversion. The system also can compliment a hybrid power system by producing additional electrical power for consumption.

FIG. 1 is a diagram of an internal combustion engine 2 and waste heat recovery (WHR) system 3 according to a generalized exemplary embodiment. The engine 2 includes a cooling system having various water jacket passageways (not shown) through which a coolant is pumped by water pump 4 into an engine coolant loop including a coolant feed line 6, radiator 8 and a coolant return line 10. A fan 12 can be electrically controlled or mechanically linked to the engine 2 to force cooler ambient air through the radiator 8 to carry away heat from the coolant radiating from the surfaces of the radiator 8.

As shown in FIG. 1, heat 14 produced by the engine 2 or other heat sources associated with the engine 2 (e.g., exhaust gases, intake air, engine oil etc.) is transferred to a working fluid cycling through a boiler (heat exchanger) 16 of the RC of the WHR 3. The working fluid is provided to the boiler 16 by a feed pump 18 that moves the liquid working fluid of the RC at high pressure in a first path through a recuperator heat exchanger 20 to an inlet of the boiler 16 where the heat transfer to the working fluid of the RC occurs. The recuperator heat exchanger 20 increases thermal efficiency of the RC by transferring heat to the working fluid while in the first path to the boiler 16. In the boiler 16, the high pressure working fluid boils off and produces a high pressure vapor that exits the boiler 16 and enters an inlet of an energy conversion device, which in this example is a high pressure expander 22, such as a turbine that rotates as a result of the expanding working fluid vapor to provide additional work, which can be fed into the engine's driveline to supplement the engine's power either mechanically or electrically (e.g., by turning a generator), although another energy conversion device can be used. The energy conversion device can be used to power electrical devices, parasitics or a storage battery (not shown). Alternatively, the energy conversion device can transfer energy from system to another system (e.g., to transfer heat energy from WHR system 3 to a fluid for a heating system).

The expanded gases exiting the outlet of the expander 22 are provided to in a second path through the recuperator heat exchanger 24 before being provided to a condenser 26. In the second path through the recuperator heat exchanger 20, heat is transferred from the working fluid to the recuperator heat exchanger 20 before entering the condenser 26. In the condenser 26, the working fluid is condensed and cooled before being provided to the feed pump 18. The feed pump 18 increases the working fluid pressure again and moves the liquid working fluid in the first path through the recuperator 20 where the fluid again absorbs heat stored while it traversed the second path through the recuperator 20, and so on.

The RC working fluid can be a nonorganic or an organic working fluid, such as Genetron™ R-245fa from Honeywell, Therminol™, Dowtherm J from the Dow Chemical Co., Fluorinol, Toluene, dodecane, isododecane, methylundecane, neopentane, neopentane, octane, water/methanol mixtures, or steam (in a non-organic Rankine cycle embodiment), for example.

The condenser 26 is cooled by a low temperature source, namely, a liquid coolant loop including a coolant feed pump 28, a condenser cooler in the radiator 8 having a split core design where heat is transferred from coolant in the condenser cooling loop (and from coolant for the engine coolant loop), a condenser coolant return line 30 and a condenser coolant feed line 32. The return line 10 of the engine cooling loop is fluidly connected to an inlet of a first core portion of the split core radiator 8, and the feed line 6 of the engine cooling loop is fluidly connected to an outlet of the first core portion of the split core radiator 8. The return line 30 of the condenser cooling loop is fluidly connected to an inlet of a second core portion of the split core radiator 8, and the feed line of the condenser cooling loop is fluidly connected to an outlet of the second core portion of the split core radiator 8. A mixing valve 60 is provided between the engine cooling loop and the condenser cooling loop to control an amount of coolant flow from the condenser cooling loop into the engine cooling loop based on load requirements of the engine and/or condenser. This, in turn, controls an amount of both portions of the radiator utilized by the engine coolant to cool the engine. For example, the valve 60 can close during off peak engine load condition and open during a high engine heat load condition.

Figure 2:
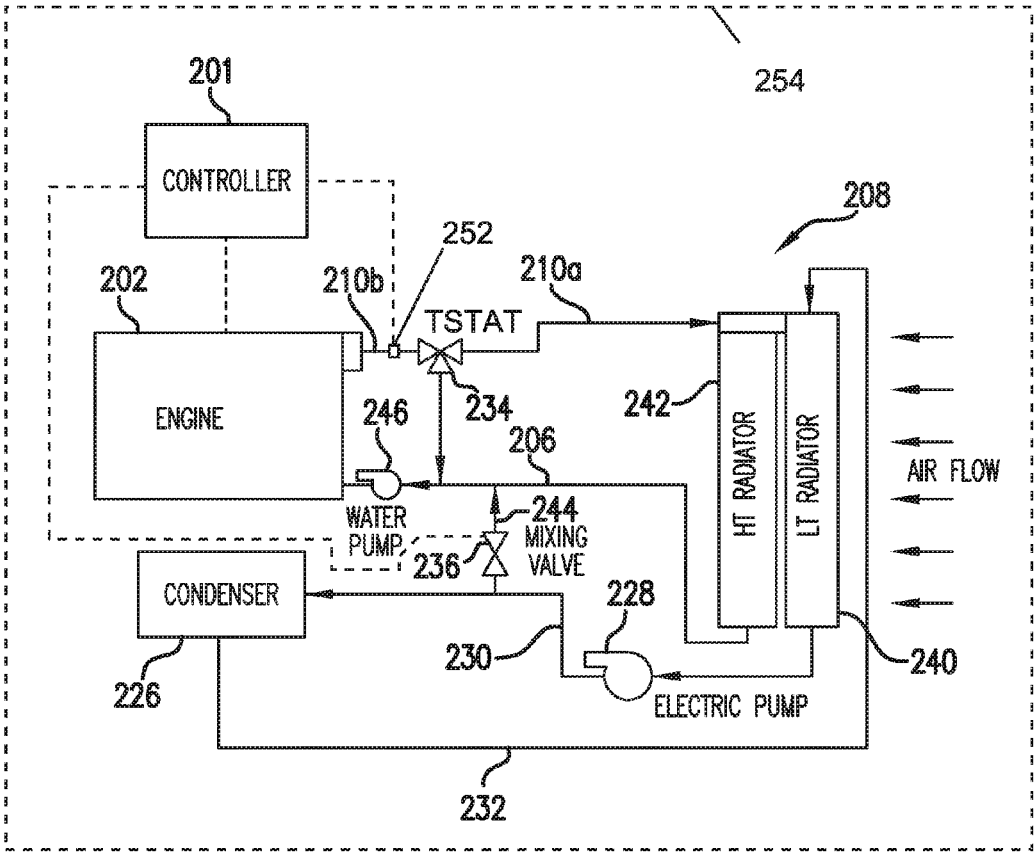
FIG. 2 is a diagram of a cooling system including a radiator having a front-to-back vertically split configuration in accordance with an exemplary embodiment.
Figure 3:
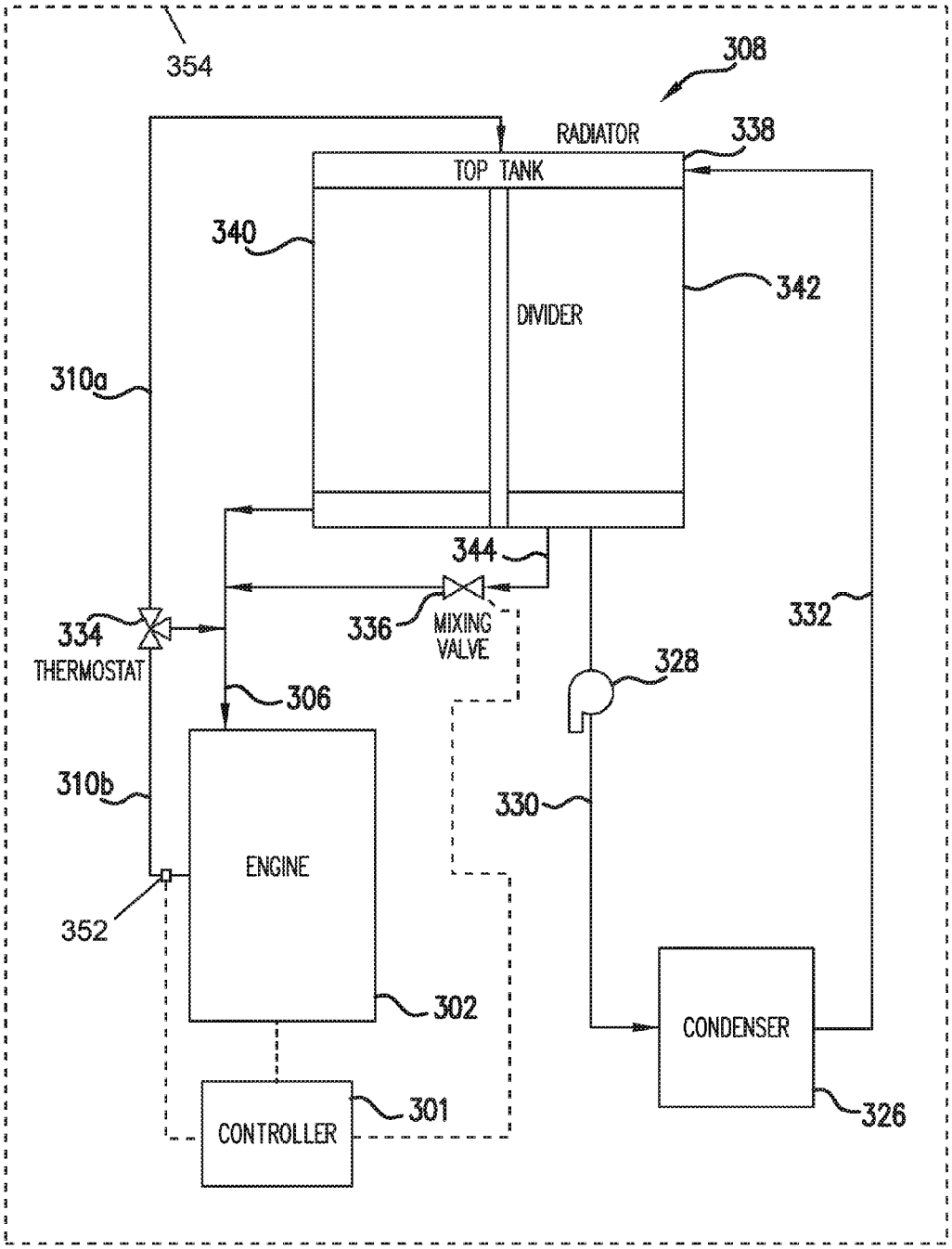
FIG. 3 is a diagram of a cooling system including a radiator having a side-by-side vertically split configuration in accordance with an exemplary embodiment.
Figure 4:
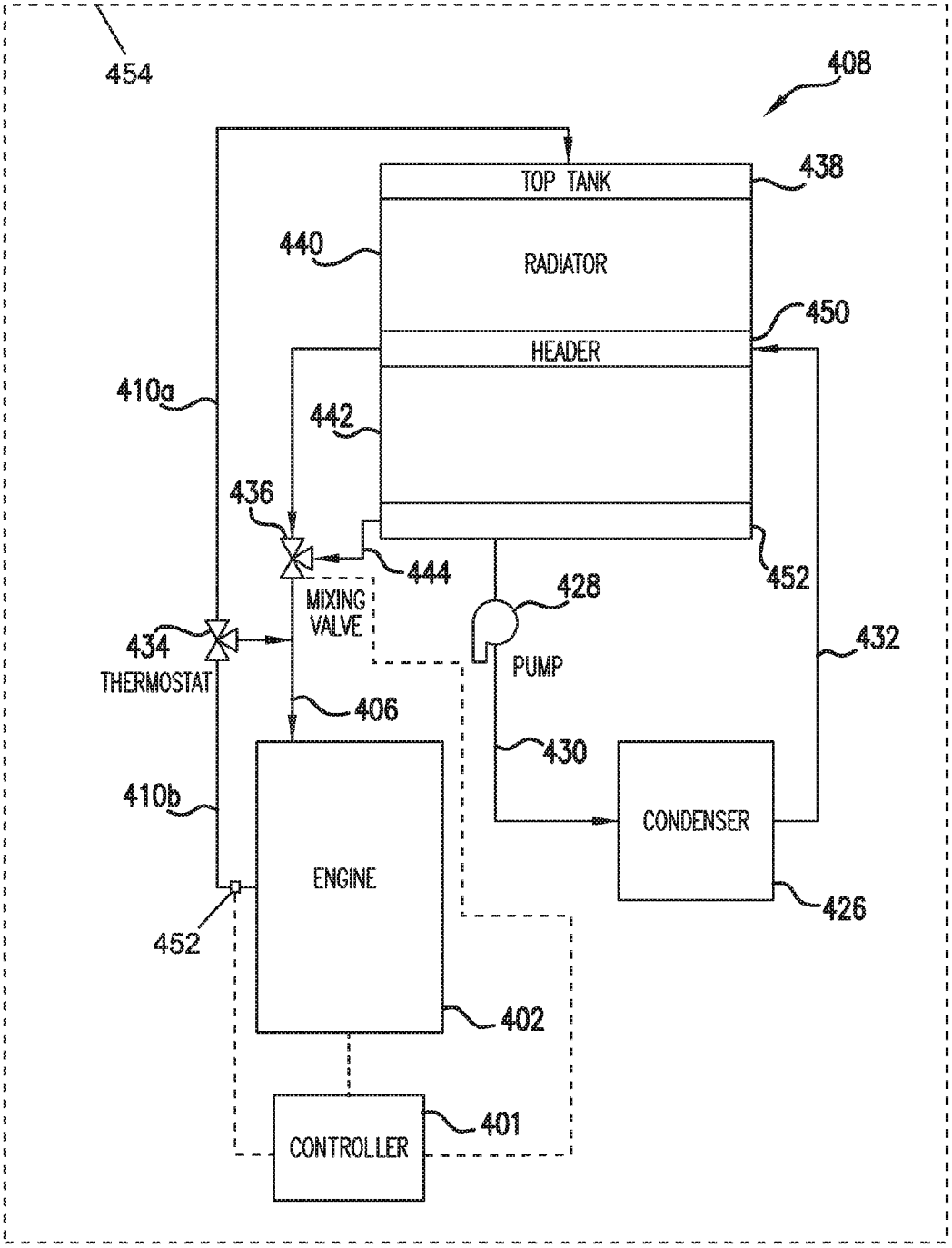
FIG. 4 shows is a diagram of a cooling system including a radiator having a horizontally split configuration in accordance with an exemplary embodiment.

Three exemplary variations of a split radiator design will now be described, although those of ordinary skill in the art would readily recognize additional embodiments consistent with the scope of the disclosure. FIGS. 2 and 3 show two split radiator designs having a vertical separation of the radiator, and FIG. 4 shows a split radiator design having a horizontal separation.

FIG. 2 shows an exemplary embodiment condenser cooler system including a front-to-back vertically split radiator. The condenser cooler system includes a condenser 226, a coolant feed pump 228 positioned along a condenser coolant feed line 230, a condenser coolant return line 232, and a radiator 208 having the vertical split layout in which core sections are arranged one-in-front-of-the-other in the direction of the cooling forced ambient air. The condenser 226 is a part of an RC of a WHR system, for example, WHR system 3 shown in FIG. 1. Other components of the RC are not shown in FIG. 2, and in FIGS. 3-4, for conciseness and clarity. Also shown in FIG. 2 is an engine coolant system, or engine loop for an engine 202. The engine coolant system includes a engine coolant feed line 206, engine coolant return line segments 210*a* and 210*b*, a thermostat 234 fluidly and controllably connecting the return line segments 210*a*, 210*b*, a mixing valve 236, an engine coolant (water) pump 246, and the radiator 208. The feed pump 228 of the condenser cooler system operates independent from the engine coolant pump 246.

The split core of the radiator 208 includes a condenser cooler, which is depicted as a low temperature (LT) radiator 240, and an engine cooler, which is depicted as a high temperature (HT) radiator 242 positioned behind the low temperature (LT) radiator 240. In the front-to-back arrangement of the radiators 240/242, the coolest air of the air flow is in contact with the low temperature (LT) radiator 242 first for maximum power potential. The heated air that is discharged from the low temperature (LT) radiator 240 travels through the second cooler, i.e., the high temperature (HT) radiator 242, which cools the engine coolant. This positioning yields a "counter-flow like" arrangement for better heat transfer. When the engine requires additional cooling, for example, as a result of the engine ECM determining that a high load condition exists, the mixing valve 236 will open to allow the lower temperature coolant to flow in line 244 from the condenser coolant loop and to be used for engine coolant.

FIG. 3 shows an exemplary embodiment of a condenser cooler system, or condenser loop that includes a radiator having a side-by-side vertically split configuration. The cooler system includes a coolant pump 328 positioned along a condenser coolant feed line 330, a condenser 326, a condenser coolant return line 332, and a radiator 308 having the vertical split layout. Also shown in FIG. 3 is an engine coolant system, or engine loop for an engine 302 including a engine coolant feed line 306, engine coolant return line segments 310*a* and 310*b*, a thermostat 334 fluidly and controllably connecting the return line segments 310*a*, 310*b*, and a mixing valve 336 (described below).

In the vertically split radiator embodiment of FIG. 3, the radiator 308 has a common top tank 338 for both engine coolant and condenser coolant to return from component cooling. Below the common top tank 338, the radiator 308 has separate cooling core areas that do not fluidly communicate with each other in the radiator 308, as indicated by the "DIVIDER" line in FIG. 3, or split running vertically from the bottom of the radiator 308 to the bottom of the top tank 338 and schematically dividing the radiator core into two core sections 340 and 342. Coolant from the engine loop and the condenser loop can flow through either side of the split (i.e., in both core sections 340, 342) after combining at the top tank 338. When the engine 302 requires less cooling, the mixing valve 336 closes, shutting off a line 344 to the core section 342 and causing the engine coolant to flow through only, or substantially only through the core section 340 of the radiator 308. This allows the condenser coolant to utilize the other side of the radiator 308 (i.e., core section 342) exclusively, or substantially exclusively for cooling the RC.

The condenser 326 uses a coolant feed pump 328 that operates independent from the engine coolant (water) pump (not shown in FIG. 3). The condenser coolant loop will typically operate at a lower temperature than the engine coolant loop. Some mixing of the two loops can occur in the top tank 338, but coolant from each loop can be made to preferentially flow to the respective side of the radiator with proper layout of piping. When the engine 302 requires additional cooling, the mixing valve 336 will open and allow the lower temperature coolant to flow in line 344 from the condenser coolant loop to be used for engine coolant. This will cause coolant from the top tank 338 to flow from the engine coolant side (i.e., the side of core section 340) to the condenser side. The effect on the condenser 326 will be higher temperatures and therefore higher pressure, resulting in lower efficiency of the Rankine cycle during peak heat load requirements for the engine 302. This system allows dual use of the radiator 308, making better use of the space claim at off-peak conditions.

FIG. 4 shows an exemplary embodiment of a horizontally split radiator of a condenser cooler system, or condenser loop including a coolant feed pump 428 positioned along a condenser coolant feed line 430, a condenser 426, a condenser coolant return line 432, and a radiator 408 having a horizontally split layout in which core sections 440 and 442 are arranged one over the other in the vertical direction of the drawing. Also shown in FIG. 4 is an engine coolant system, or engine loop for an engine 402 including a engine coolant feed line 406, engine coolant return line segments 410*a* and 410*b*, a thermostat 434 fluidly and controllably connecting the return line segments 410*a*, 410*b*, a mixing valve 436, and an engine coolant (water) pump (not shown).

The horizontally split layout shown in FIG. 4 functions in a manner similar to the side-by-side vertically split configuration shown in FIG. 3. This is accomplished by using only the portion of the radiator required for engine cooling, while using the space more effectively at off-peak conditions for cooling the condenser. The radiator has a top-tank 438 for engine coolant only and a header 450 in the center to collect coolant from a top portion 440 of the radiator and the return 432 from the condenser 426. A bottom header 452 is provided on the bottom of a lower portion 442 of the radiator and is used for the condenser loop all the time and also when required for engine cooling. The top portion 440 of the radiator is always used for engine cooling. When the top portion 440 cannot provide adequate engine cooling, the mixing valve 436 repositions proportionately to utilize the lower portion 442 of the radiator as needed by directing more coolant flow through the lower portion 442 of the radiator and out through line 444 connected between the bottom header 452 and the mixing valve 436 rather than being drawn from the middle header 450. This would raise the temperature of the coolant returning to the condenser at peak heat load conditions, and thus decrease the efficiency of the Rankine cycle during that time.

The mixing valve 236, 336 and 436, as well as the thermostats 234, 334, and 434 can be controlled thermally and/or mechanically, or by way of using sensors, such as sensors 252, 352, 452, to monitor engine and/or condenser coolant conditions and controlling actuators that can open and close these devices based on the sensed conditions. For example, a vehicle 254, 354, 454 utilizing a system in accordance with embodiments consistent with the claimed invention can include a controller 201, 301, 401, which can be, for example, an electronic control unit (ECU) or electronic control module (ECM) that monitors the performance of the engine 202, 302, and 402 and other elements of the vehicle 254, 354, 454. The controller 201, 301, 401 can be a single unit or plural control units that collectively perform these monitoring and control functions of the engine and condenser coolant system. A controller 201, 301, 401 can be provided separate from the coolant systems and communicate electrically with systems via one or more data and/or power paths. The controller 201, 301, 401 can also utilize sensors (e.g., sensors 252, 352, 452), such as pressure, temperature sensors to monitor the system components and determine whether these systems are functioning properly. The controller 201, 301, 401 can generate control signals based on information provided by sensors (e.g., sensors 252, 352, 452) described herein and perhaps other information, for example, stored in a database or memory integral to or separate from the controller 201, 301, 401.

The controller 201, 301, 401 can include a processor and modules in the form of software or routines that are stored on computer readable media such as memory, which is executable by the processor of the controller 201, 301, 401. In alternative embodiments, modules of controller 201, 301, 401 can include electronic circuits for performing some or all or part of the processing, including analog and/or digital circuitry. The modules can comprise a combination of software, electronic circuits and microprocessor based components. The controller 201, 301, 401 can receive data indicative of engine performance and exhaust gas composition including, but not limited to engine position sensor data, speed sensor data, exhaust mass flow sensor data, fuel rate data, pressure sensor data, temperature sensor data from locations throughout the engine 202, 302, and 402, an exhaust aftertreatment system, data regarding requested power, and other data. The controller 201, 301, 401 can then generate control signals and output these signals to control the mixing valves 236, 336 and 436 and the thermostats 234, 334, and 434.

Modifications of each of the above embodiments are within the scope of the disclosure. For instance, the front-to-back radiator portions 240 and 242 of vertically split radiator 208 of the condenser cooler system shown in FIG. 2 can include a common top tank, the electric coolant pumps can instead be mechanically driven pumps. Additionally, sensors (e.g., sensors 252, 352, 452) can be provided in each of the engine coolant loop and the condenser coolant loop to sense temperature and/or pressure characteristic and generate a signal indicative of the characteristic. The controller can use this information to provide additional control levers to the coolant system. For example, if a temperature of coolant in the engine coolant loop monitored by the controller exceeds a predetermined level for a period of time, the controller can receive this information and control the mixing valve to increase the flow of the coolant from the low temperature loop into the high temperature loop. Also, flow control can be provided to the condenser coolant loop, such as controlling the operation of the pump (228, 328, 428) via the controller when maximal engine cooling is required, or via some other control, such as a flow restrictor.

Although a limited number of embodiments is described herein, those skilled in the art will readily recognize that there could be variations, changes and modifications to any of these embodiments and those variations would be within the scope of the disclosure.

What is claimed is:

1. A cooling system for an internal combustion engine and waste heat recovery system using a Rankine cycle, comprising:

a radiator having a first cooling core portion divided from a second cooling core portion, and positioned downstream from a flow of cooling air, wherein the first cooling core portion and the second cooling core portion are fluidly connected by a common tank;

an engine cooling loop including an engine coolant return line fluidly connected to an inlet of the second cooling core portion, and an engine coolant feed line connected to an outlet of the second cooling core portion;

a condenser of the waste heat recovery system, said condenser fluidly coupled to a condenser cooling loop including a condenser coolant return line fluidly connected to an inlet of the first cooling core portion, and a condenser coolant feed line fluidly connected an outlet of the first cooling core portion;

a valve connected between the engine cooling loop and the condenser cooling loop and configured to adjustably control the flow of coolant in the condenser cooling loop into the engine cooling loop; and a controller communicatively coupled to the valve, said controller adapted to determine a load requirement for the internal combustion engine and adjust said valve in accordance with said engine load requirement.

2. The cooling system according to claim 1, wherein the valve is a mixing valve.

3. The cooling system according to claim 1, wherein the waste heat recovery system includes a turbine mechanically coupled to an electric generator.

4. The cooling system according to claim 1, further comprising a fan adapted to provide at least a portion of the flow of cooling air.

5. The cooling system according to claim 1, further comprising a sensor coupled to the engine coolant loop, said sensor generating a signal indicative of a temperature characteristic of coolant in the engine coolant loop, wherein said controller is adapted to adjust the valve to increase coolant flow from the condenser coolant loop to the engine coolant loop when the generated signal exceeds a predetermined level.

6. The cooling system according to claim 1, wherein the common tank is a top tank in fluid receiving communication with the inlet of the first cooling core portion and the inlet of the second cooling core portion, and in fluid providing communication with the first cooling core portion and the second cooling core portion.

7. The cooling system according to claim 6, wherein the valve is disposed in a valve line in fluid receiving communication with the first cooling core portion and in fluid providing communication with the engine cooling loop, and wherein the controller causes the valve to direct an increased amount of coolant from the first cooling core portion to the to the engine cooling loop in response to an increased engine load.

8. The cooling system according to claim 1, wherein the common tank is a header disposed between the first cooling core portion and the second cooling core portion, the header in fluid receiving communication with the second cooling core portion and the inlet of the first cooling core portion, and in fluid providing communication with the first cooling core portion and the outlet of the second cooling core portion.

9. The cooling system according to claim 8, wherein the valve is in fluid providing communication with the engine cooling loop and in fluid receiving communication with the header and the first cooling core portion, and wherein the controller causes the valve to direct a decreased amount of coolant from the header and an increased amount of coolant from the first cooling core portion to the engine cooling loop in response to an increased engine load.

10. The cooling system according to claim 1, wherein the valve is disposed in a valve line in fluid receiving communication with the condenser coolant feed line and in fluid providing communication with the engine coolant feed line, wherein the controller causes the valve to direct coolant in the condenser coolant feed line to the engine coolant feed line in response to an increased engine load.

11. The cooling system according to claim 1, wherein the first cooling core portion and the second cooling core portion are positioned in a side-by-side configuration, and wherein the flow of cooling air passes through the first cooling portion and the second cooling portion simultaneously.

12. The cooling system according to claim 1, wherein the engine load requirement is determined from at least one of engine position data, mass airflow data, fuel rate data, fluid pressure data, and temperature data.

13. The cooling system according to claim 1, wherein the valve is disposed in fluid receiving communication with the condenser cooling loop and in fluid providing communication with the engine cooling loop, wherein the controller maintains the valve in a closed configuration below a threshold engine load condition and opens the valve at or above the threshold engine load condition, wherein the valve in an open configuration allows fluid communication between the condenser cooling loop and the engine cooling loop, and wherein the valve in a closed configuration prevents fluid communication between the condenser cooling loop and the engine cooling loop.

14. A cooling system for an internal combustion engine and waste heat recovery system using a Rankine cycle, comprising:

a radiator having a first cooling core portion divided from a second cooling core portion, and positioned downstream from a flow of cooling air;

an engine cooling loop including an engine coolant return line fluidly connected to an inlet of the second cooling core portion, and an engine coolant feed line connected to an outlet of the second cooling core portion;

a condenser of the waste heat recovery system, said condenser fluidly coupled to a condenser cooling loop including a condenser coolant return line fluidly connected to an inlet of the first cooling core portion, and a condenser coolant feed line fluidly connected an outlet of the first cooling core portion;

a valve connected between the engine cooling loop and the condenser cooling loop and configured to adjustably control the flow of coolant in the condenser cooling loop into the engine cooling loop; and a controller communicatively coupled to the valve, said controller adapted to determine a load requirement for the internal combustion engine and adjust said valve in accordance with said engine load requirement;

wherein the first cooling core portion is disposed upstream of the second cooling core portion in a front-to-back configuration, and wherein at least some of the flow of cooling air passes through the first cooling core portion before passing through the second cooling core portion.

15. A vehicle with an internal combustion engine, comprising:

a waste heat recovery system having a condenser;

a radiator positioned downstream from a flow of cooling air and having a first cooling core portion divided from a second cooling core portion, wherein the first cooling core portion is disposed upstream of the second cooling core portion in a front-to-back configuration, and wherein at least some of the flow of cooling air first passes through the first cooling core portion and then passes through the second cooling core portion;

an engine cooling loop including an engine coolant return line fluidly connected to an inlet of the second cooling core portion, and an engine coolant feed line connected to an outlet of the second cooling core portion;

a condenser cooling loop fluidly coupled to the condenser and including a condenser coolant return line fluidly connected to an inlet of the first cooling core portion, and a condenser coolant feed line fluidly connected an outlet of the first cooling core portion;

a valve connected between the engine cooling loop and the condenser cooling loop and configured to adjustably control the flow of coolant in the condenser cooling loop into the engine cooling loop; and a controller communicatively coupled to the valve, the controller adapted to determine a load requirement for the internal combustion engine and adjust the valve in accordance with the engine load requirement.

16. The vehicle according to claim 15, further comprising a fan providing at least a portion of the flow of cooling air.

17. The vehicle according to claim 15, further comprising a sensor coupled to the engine coolant loop, the sensor generating a signal indicative of a temperature characteristic of coolant in the engine coolant loop, and wherein the controller is adapted to adjust the valve to increase coolant flow from the condenser coolant loop to the engine coolant loop when the generated signal exceeds a predetermined level.

* * * * *